US005442861A

United States Patent [19]

Lorocco

[11] Patent Number: 5,442,861

[45] Date of Patent: Aug. 22, 1995

[54] SIGHT PIN AND HOLDER FOR ARCHERY BOW

[76] Inventor: Paul M. Lorocco, 4110 Shady Hill Dr., Dallas, Tex. 75229

[21] Appl. No.: 173,503

[22] Filed: Dec. 23, 1993

[51] Int. Cl.[6] ..... F41G 1/467; F41G 1/32

[52] U.S. Cl. ..... 33/241; 33/265; 124/87

[58] Field of Search ..... 33/241, 265; 124/87

[56] References Cited

U.S. PATENT DOCUMENTS

| | | | |
|---|---|---|---|
| 3,568,323 | 3/1971 | Lendway | 33/265 |
| 3,579,839 | 5/1971 | Kowalski | 33/265 |
| 3,822,479 | 7/1974 | Kowalski | 33/265 |
| 4,177,572 | 12/1979 | Hindes | 33/265 |
| 4,495,705 | 1/1985 | Kowalski et al. | 33/241 |
| 4,819,611 | 4/1989 | Sappington | 33/265 |
| 4,928,394 | 5/1990 | Sherman | 33/265 |
| 5,001,837 | 3/1991 | Bray | 33/265 |
| 5,094,002 | 3/1992 | Saunders | 33/265 |
| 5,121,462 | 6/1992 | Fabre et al. | 385/143 |
| 5,168,540 | 12/1992 | Winn et al. | 385/128 |
| 5,168,631 | 12/1992 | Sherman | 33/265 |
| 5,201,124 | 4/1993 | Sherman | 33/265 |
| 5,231,765 | 8/1993 | Sherman | 33/241 |

OTHER PUBLICATIONS

Saunders Archery, brochure T-Dot Sight Pin No Date.

Optectron—Plastiro brochure Sep. 1991.

*Primary Examiner*—Thomas B. Will

*Attorney, Agent, or Firm*—Timmons & Kelly; Daniel Rubin

[57] ABSTRACT

A sight unit comprising a pin and holder for an archery bow adaptable for mounting onto a sight assembly of the bow and including an elongated length of a light gathering fluorescent fiber defining a lens at its distal end to which gathered ambient light becomes focused to serve as an aiming indicia. A holder adapted for secured mounting onto the sight assembly includes a transverse bore through which the fiber is received while an adjustment screw enables clamping or loose positioning of the fiber in the bore for adjustment setting of the lens position.

36 Claims, 5 Drawing Sheets

SIGHT PIN AND HOLDER FOR ARCHERY BOW

FIELD OF THE INVENTION

The field of art to which the invention relates comprises sighting indicia for aiming an arrow on an archery bow.

1. Background of the Invention

Aiming sights are commonly used as a reference indicia on archery bows and are available from a variety of commercial sources. The sights usually consist of a bracket secured to a sight assembly on the bow to support a plurality of vertically spaced sight elements extending cantilevered to an end adjacent a vertical sight plane. Each of the different sight elements typically represent distinct target distances from which the archer can select in the aiming of his arrow toward an intended target.

2. Background of the Prior Art

Because use of the bow and arrow for hunting of game or target shooting frequently occurs under low light conditions when visibility of the sight element can become poor, if not virtually non-existent, various sight units have been developed that gather ambient light to amplify visibility. Such units have generally consisted of a light enhancement sight unit disclosed, for example, in U.S. Pat. No. 4,928,394 in which metal clad fiber optic sight pins are used to create an illuminated sight bead. U.S. Pat. No. 5,168,631 discloses use of molded plastic plate members comprised of fluorescent dye translucent plastic that absorb ambient light waves conducted to the plate edges. U.S. Pat. No. 5,201,124 discloses use of a dye impregnated light conducting plastic formed as an elongated tapered and rigid pin having a distal end to which collected light is conducted.

OBJECTS OF THE INVENTION

It is an object of the invention to provide a novel light gathering sight unit for the sight assembly of an archery bow having a sight pin affording significantly enhanced illumination at its aim indicia compared to similar purpose light gathering pins of the prior art.

It is a further object of the invention to provide a novel holder to enable mounting the sight pin of the previous object as a replacement unit on an existing sight assembly or adapted for installation on an original equipment sight assembly.

It is a still further object of the invention to provide an archery bow with a sight assembly utilizing the sight unit of the previous objects.

SUMMARY OF THE INVENTION

This invention relates to a novel sight pin and holder unit for use on an archery bow. More specifically, the invention relates to such a sight unit for use as a unit replacement on existing sight assemblies or as the sight unit to be installed on original equipment as the aim indicia for the arrow. By means of a selected fiber utilized in the unit, significantly enhanced light glow is provided at the aim indicia even under low light conditions as compared to similar purpose type pins of the prior art.

The foregoing is achieved in accordance with the invention utilizing a predetermined length of pin formed of a fluorescent dye fiber composition. An enlargement at the distal end of the fiber comprises a lens that serves as the aim point indicia of the sight unit when mounted onto a sight assembly. The fiber is of a type known as a scintillating fiber or wavelength shifter characterized as absorbing ambient light through the body which focuses to a bright glow at the lens comprising the aim point indicia. The superior brightness, smaller size, unique fiber shape, lens and distinctive fluorescent colors distinguish the fiber hereof from other commercially available sight pin products. A protective transparent sleeve can be utilized over a partial length of the fiber where secured by a holder or bracket.

The holder or bracket serves to mount and secure the fiber onto an assortment of sight assemblies and is comprised of a clear polycarbonate body uniquely shaped to receive and secure the fiber while accommodating selective position settings of the aim point indicia. Being adjustably settable, the holder can be oriented and positioned by the archer on the sight assembly so as to place the fiber aim point in a location preferred and selected by the archer. A uniquely positioned pressure adjustment screw on the holder allows for both horizontal as well as vertical positioning of the fiber aim point while being readily accessible for adjustment and setting in a variety of preferred arrangements and/or spacings.

A multiplicity of sight holders and fiber aim points can be assembled to create multiple aim points on a particular sight assembly. Holders for that purpose can be arranged in various configurations to create very close groupings of aim points that function as separate distance indicators on the sight unit.

The above noted features and advantages of the invention as well other superior aspects thereof will be further appreciated by those skilled in the art upon reading the detailed description which follows in conjunction with the drawings.

DESCRIPTION OF THE PREFERRED EMBODIMENT

Figure 1:
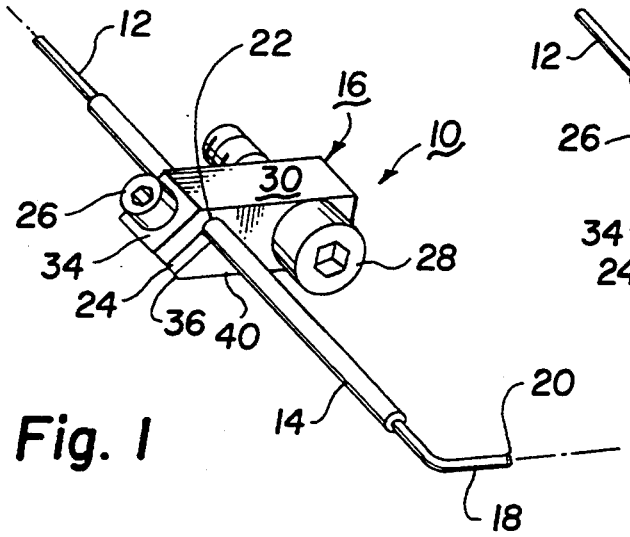
FIG. 1 is an isometric view of the fiber pin and holder unit hereof in a first embodiment adapted for mounting onto a sight assembly.

In the description which follows, like parts are marked throughout the specification and drawings with the same reference numerals respectively. The drawing figures are not necessarily to scale and in certain views, parts may have been exaggerated for purposes of clarity.

Referring now to the drawings, there is illustrated in FIG. 1 a first embodiment of the invention hereof, designated 10, comprised of an elongated length of fluorescent fiber 12 partially enclosed in a thin transparent sleeve 14 and together secured in a holder or bracket 16. The fiber longitudinally extends to an offset 18 that terminates at its distal end in an enlarged formation comprising a lens 20 to serve as the aim point indicia, as will be understood.

For securing the fiber and sleeve within holder 16, the holder (see also FIGS. 13–18) is comprised of a transparent polycarbonate body 30 that includes a transverse bore 22 communicating with an open slotted jaw 24. By means of jaw 24, an adjusting screw 26 can be tightened and loosened to accommodate receipt and clamping of fiber 12 within sleeve 14. An attachment screw 28 enables unit 10 to be mounted onto an assortment of available sight assemblies.

Fiber 12 is comprised of about a two to four inch length of a fluorescent dye polymer having a diameter of approximately 0.030 inches that typically varies from 0.020 to 0.080 inches. It is of a composition characterized as light gathering along its length to conduct and focus gathered light at the lens 20 operative as the archer's aim point indicia. Such fibers are available from commercial sources such as Optectron Inc. of Raynham Mass. under the trademark "Plastifo" and may be of a type disclosed, for example, in U.S. Pat. No. 5,121,462 incorporated herein by reference.

Fiber elements of this type are commonly identified as scintillating optical fibers and/or wave length shifters and typically, comprise a polymer base such a polystyrene core to which a fluorescent dopant has been added along with a fluoropolymer cladding. The dopant is chosen so as to cause fiber light absorption over a specific wave length that is transformed into a longer wave length that is re-emitted in amplified form at the extremities of the fiber. The thin cladding is of a lower refractive index than the fiber for improving light transmission along its length and to focus the light to an astounding brightness at its distal end that in accordance herewith, may include lens 20. Commercially, the fiber is commonly available in coiled lengths which are cut to size. For the purposes hereof, they are bent after which the lens 20 is added by application of heat which mushrooms the fiber end producing a thickened convex lens. Optimum brightness typically occurs at a length of approximately one meter, such that the shorter the length the less the light. By the same token, increased lengths can be achieved approaching one meter by various well known wrapping, bending or coiling techniques.

Sleeve 14 extends a partial length of the fiber to afford rigidity and protection of the fiber over at least the fiber length clamped in holder 16. The sleeve is of a transparent plastic composition such as polyethylene and sized to slideably fit snugly over the fiber.

Holder 16, as will now be further described with reference again to FIGS. 13–18, is comprised of a generally rectangular, transparent polycarbonate body 30 having one end defined in profile by intersecting wedge faces 34 and 36. The latter includes slotted jaw 24 communicating inward with tranverse bore 22. Formed in face 34 is a double bore 38 extending through to the under surface 40 for receiving self tapping adjustment screw 26. An unthreaded lateral side bore 32 receives a mounting screw 28 for attaching the unit 10 to a suitable sight assembly, as will be explained. With fiber 12 secured in bore 22, lens 20 is intended to be positioned adjacent a sight plane 31 representing a trajectory path of the arrow when released and can be adjustably set via adjustment screw 26.

Figure 2:
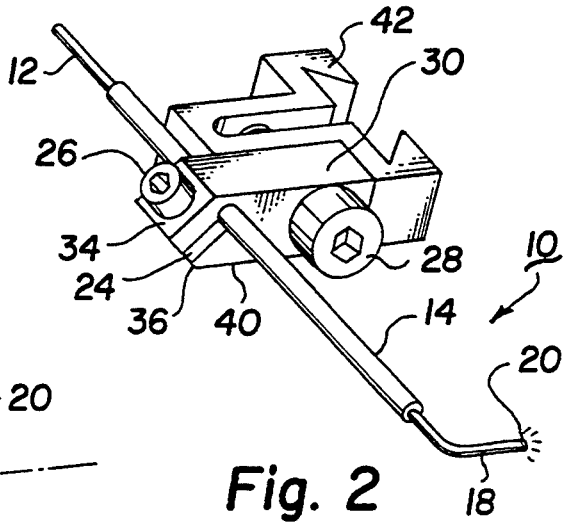
FIG. 2 is an isometric view of the pin and holder unit of FIG. 1 mounted onto a typical dovetail pin block.
Figure 3:
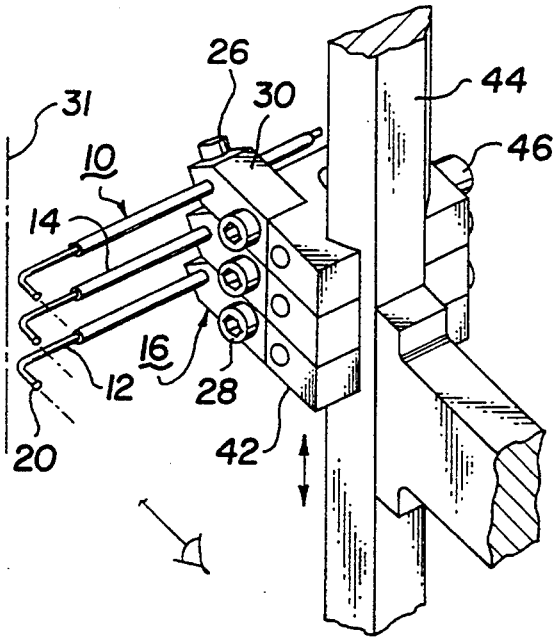
FIG. 3 is an isometric view of the assembly of FIG. 2 mounted onto a typical dovetail sight bar type sight assembly.
Figure 4:
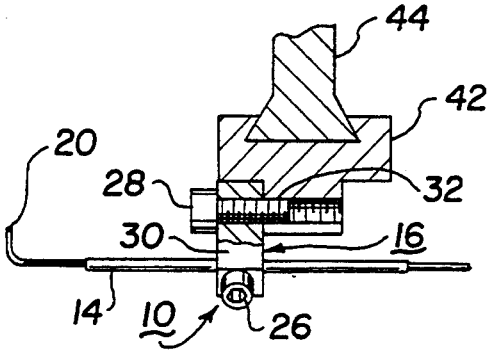
FIG. 4 is a fragmentary sectional view through the assembly of FIG. 3.

Referring now to FIGS. 2, 3 and 4, the unit 10 hereof is shown secured to an existing dovetail pin block 42 for use on a sight bar 44 of a sight assembly (not shown). Such assemblies are available from Martin Archery being their model no. 4125. Individual mounting screws 46 in each of the pin blocks 42 can be loosened to enable vertical displacement and position setting of the respective pin blocks on bar 44. In this arrangement, each of the stacked pins can represent a separate target distance to which the archer can refer relative to sight plane 31 in the aiming of his arrow toward a selected target.

Figure 5:
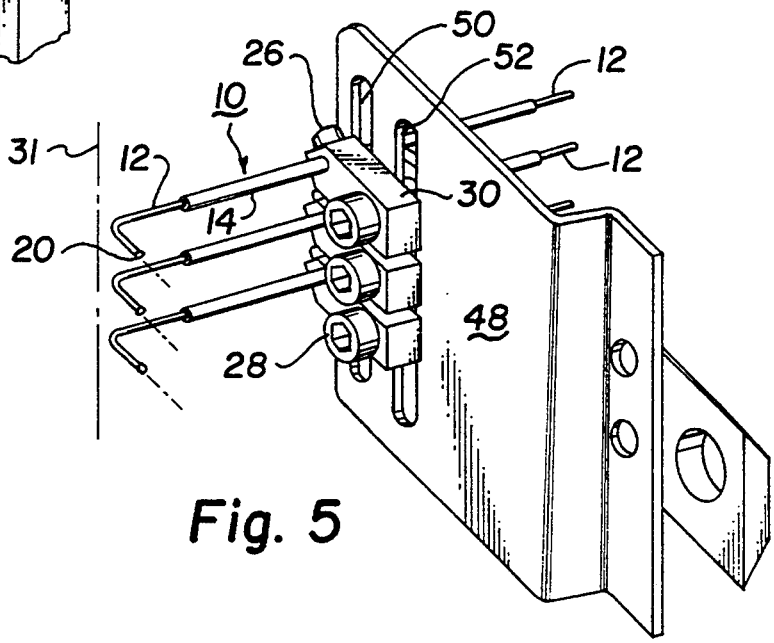
FIG. 5 is an isometric view of the unit of FIG. 1 mounted on a typical slotted sight housing.
Figure 6:
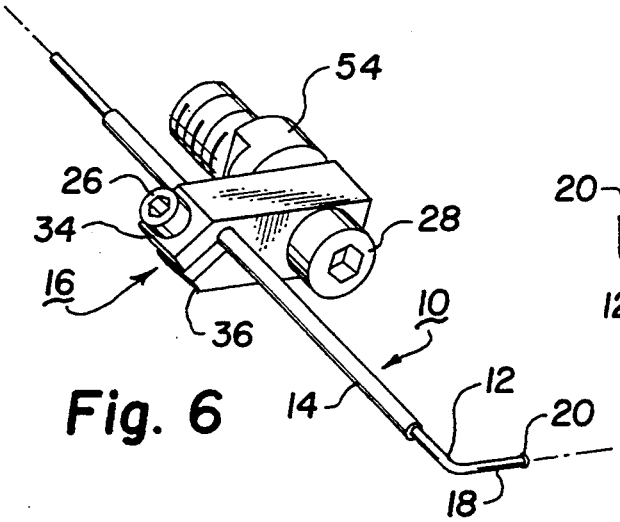
FIG. 6 is an isometric view of the pin and holder unit modified to accommodate the slotted sight housing of FIG. 5.
Figure 7:
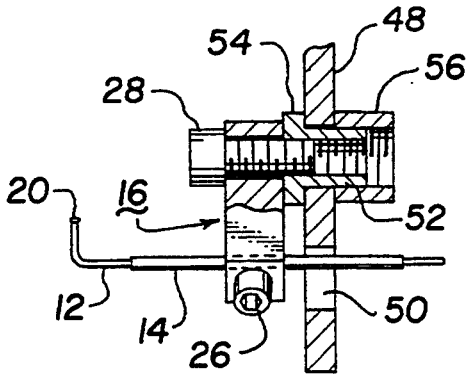
FIG. 7 is a fragmentary sectional view through the assembly of FIG. 5.

As shown in FIGS. 5–7, the individual units 10 are adapted for mounting on a slotted housing designated 48, of a sight assembly (not shown). Such assemblies are available from Hoyt USA being their model no. Gamegetter. Included in housing 48 are vertical and parallel slots 50 and 52. For this installation, a threaded fitting 54 threadedly receives the end of attachment screw 28 for extending through slot 52 while a nut 56 secures the fitting against the opposite face of the housing. As before, the individual fiber lenses 20 extend parallel and adjacent to the archer's sight plane 31.

Figure 8:
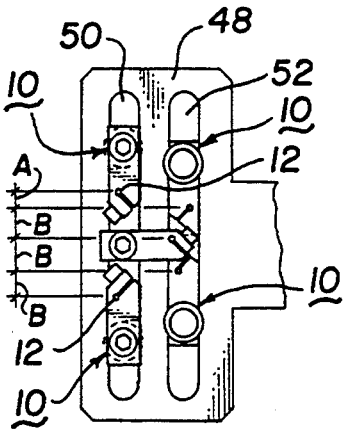
FIGS. 8(*a*), (*b*), (*c*) and (*d*) exemplify optional spacing arrangements for the sight pins that might be utilized on the slotted sight housing of FIG. 5.
Figure 8:
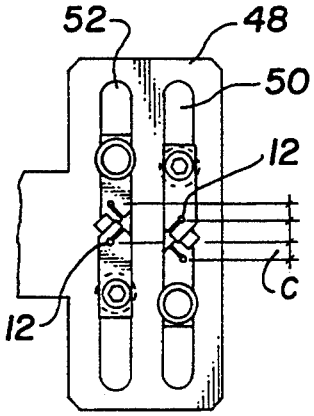
Figure 8:
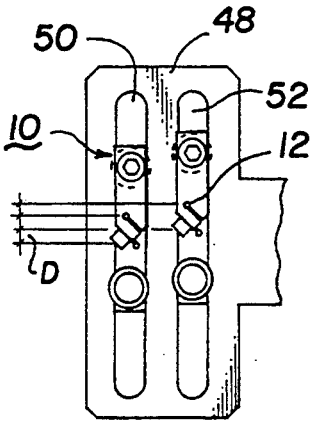
Figure 8:
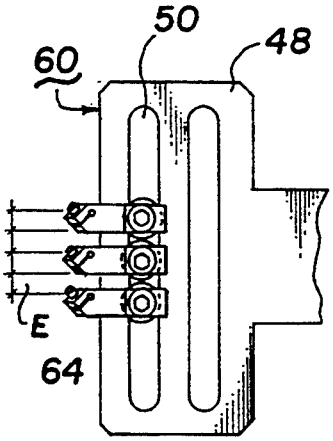

Referring to FIGS. 8(*a*), (*b*), (*c*) and (*d*), there is illustrated exemplarly arrangements for achieving desired center-to-center spacing of the multiple sight pins on the slotted sight housing 48 of FIG. 5. In FIG. 8(*a*), three of the units 10 are secured in different orientations through slot 50 on the front face of housing 48. The two remaining units are secured through slot 52 on the back face of housing 48. With this arrangement, the top two pins 12 achieve a vertical center-to-center spacing "A" of about ⅛ inch whereas the remaining pins have a vertical center-to-center spacing "B" of about ¼ inch. In FIG. 8 (*b*), the lower unit in slot 50 and the upper unit in slot 52 are secured to the front face of housing 48 whereas the remaining two units are secured from the back face. Collectively, they provide a uniform center-to-center spacing "C" of about 5/32 inches. In FIG. 8 (*c*), the vertical center-to-center spacing between the fibers is represented by dimension "D" of approximately 3/32 inches. FIG. 8(*d*) achieves a uniform center-to-center spacing "E" of about ⅜ inches.

Evident from the foregoing is that a variety of different fiber spacings, can be readily achieved at the option of the archer by merely displacing a unit 10 to a desired position and orientation. It should likewise be evident that in whatever arrangement selected, adjusting screw 26, by virtue of the shape of holder 16, remains accessible in order to preset or adjust a specific location of the lens 20 relative to sight plane 31.

Figure 9:
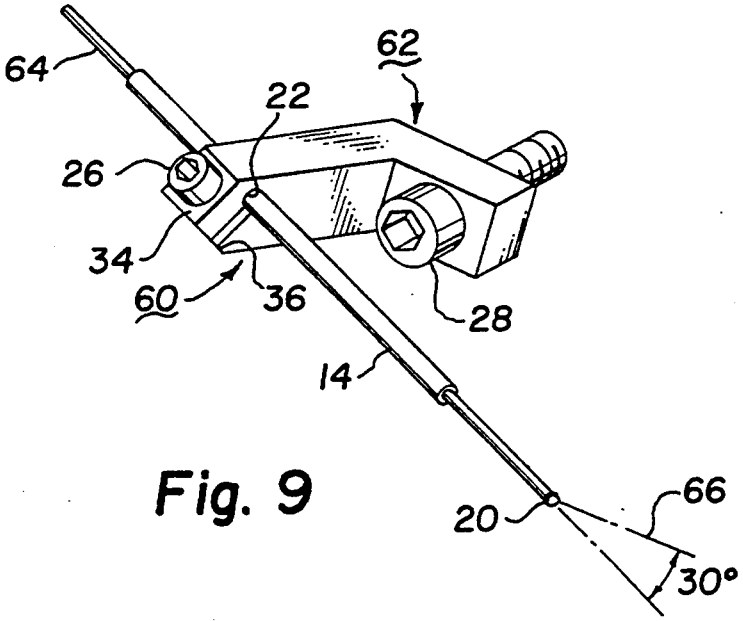
FIG. 9 is an isometric view of a second embodiment of fiber pin and holder unit in accordance with the invention hereof.
Figure 10:
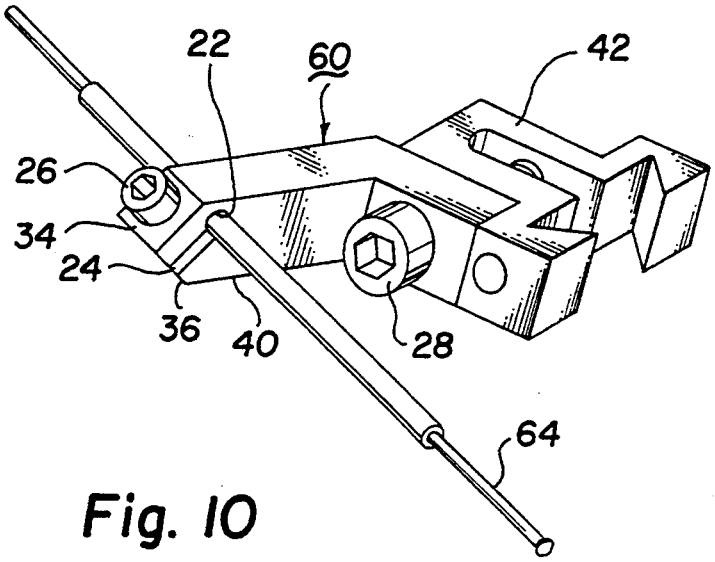
FIG. 10 is an isometric view of the pin and holder unit of FIG. 9 mounted onto a typical dovetail pin block.
Figure 11:
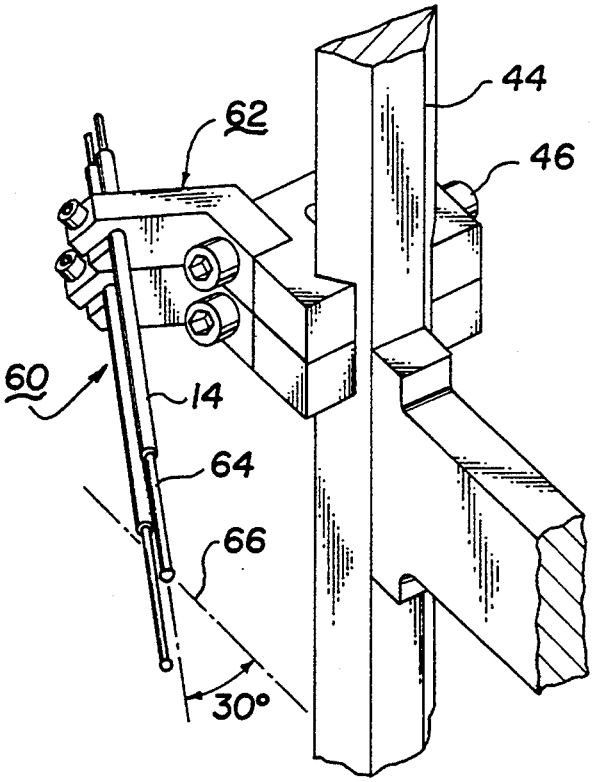
FIG. 11 is an isometric view of the assembly of FIG. 10 mounted onto a typical dovetail sight bar type sight assembly.
Figure 12:
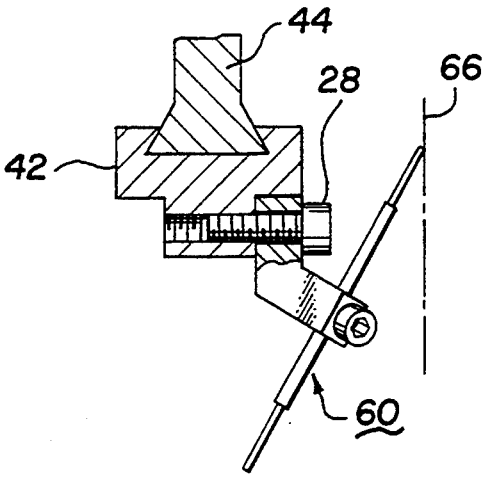
FIG. 12 is fragmentary sectional view through the assembly of FIG. 11.
Figure 13:
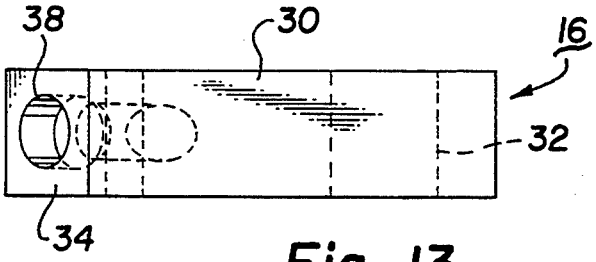
FIG. 13 is a top plan view of the holder bracket of FIG. 1.
Figure 16:
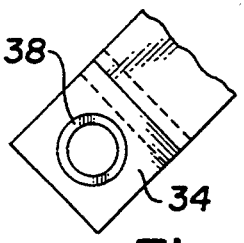
FIG. 16 is a partial top projection of the holder bracket FIG. 1.
Figure 17:
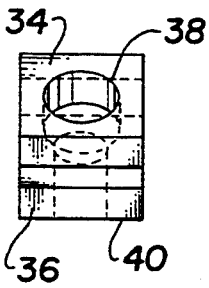
FIG. 17 is front elevation of the holder bracket of FIG. 1.
Figure 14:
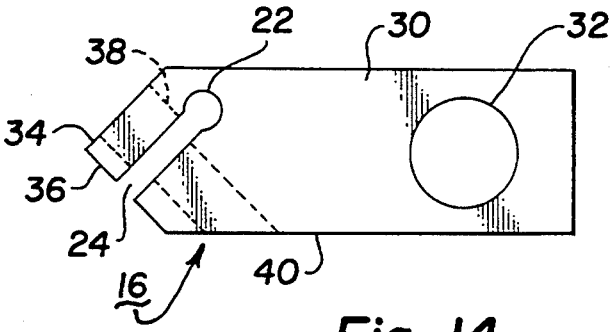
FIG. 14 is a side elevation of the holder bracket of FIG. 1.
Figure 18:
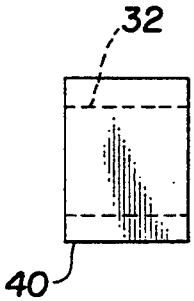
FIG. 18 is rear elevation of the holder bracket of FIG. 1.
Figure 15:
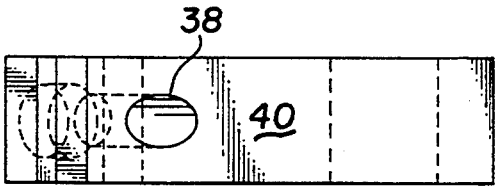
FIG. 15 is a bottom plan view of the holder bracket of FIG. 1.

Referring now to FIGS. 9–11, there is disclosed a second embodiment sight unit, designated 60. This embodiment is similar to the embodiment described supra except that holder 60 includes an angular offset at 62 of about 120 degrees in order to accommodate and secure an unbent straight fiber 64 otherwise similar to fiber 12. This sight unit arrangement is normally utilized with a sight plane 66 offset about 30 degrees from the axis of pin 64. FIGS. 10, 11, and 12 illustrate dovetail mountings for this embodiment similar to FIGS. 2, 3, and 4 described supra.

Figure 19:
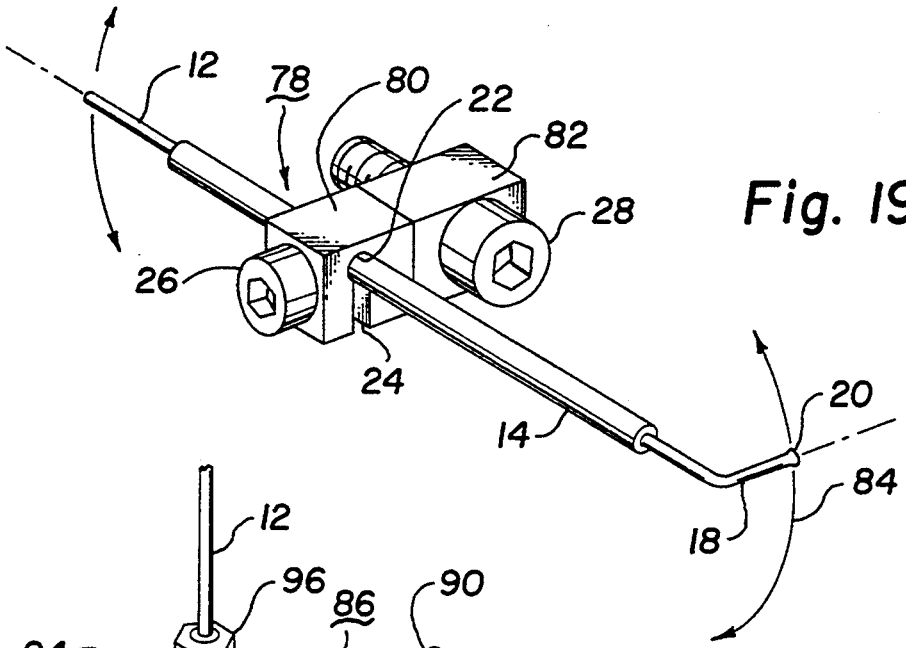
FIG. 19 is an isometric view of a fiber pin and holder unit construction in alternative to the first embodiment of FIG. 1.

FIG. 19 illustrates an alternative holder construction designated 78, for the holder 16 of FIG. 1. Holder 78 has a body formed as either a one piece rectangular block or as a tandem two piece rectangular block as shown. For the shown two piece construction, there is provided a front plastic holder 80 pivottally secured to rear metal holder 82 via a threaded post (not shown). This permits vertical displacement of lens 20 about the pivot axis to a selected location along the lines of arrow 84.

Figure 20:
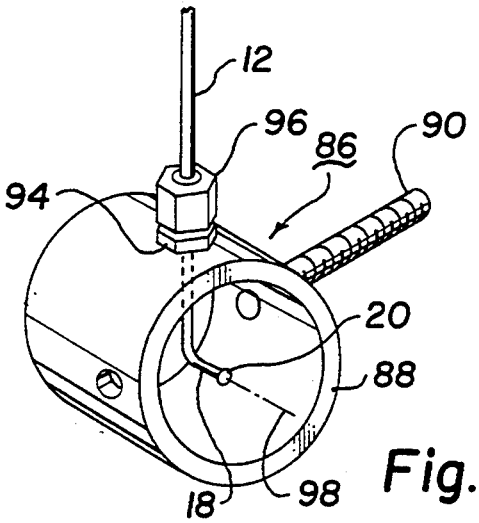
FIG. 20 is an isometric view of the fiber pin and holder unit hereof as utilized on a scope type sight assembly.
Figure 21:
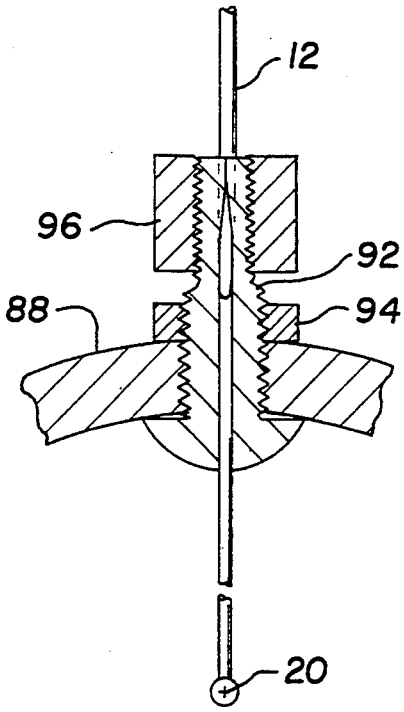
FIG. 21 is an enlarged sectional elevation through the pin and holder unit of FIG. 20.

FIGS. 20 and 21 illustrate use of fiber 12 in a commercially available scope type sight designated 86. The sight includes a tubular body 88 secured to a threaded lateral mounting post 90. To secure fiber 12, there is provided a tubular screw 92 slotted inward for about ¼ inch from its distal end. The screw is threaded through scope body 88 where it is secured in place by attachment nut 94. Fiber 12 is initially disposed loosely within screw 92, until positioned with offset 18 and lens 20 coinciding along the body axis 98. Adjustment nut 96 is then tightened on screw 92 so as to compress the slotted end portion of the screw and clamp the fiber thereat.

Figure 22:
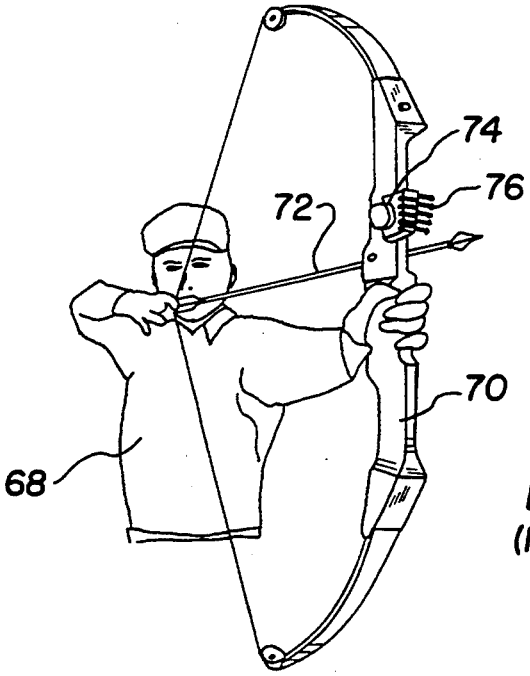
Fig. 22 (PRIOR ART)
FIG. 22 is a vertical isometric view of a prior art archery bow set.

FIG. 22 isometrically illustrates an archer 68 operating a bow 70 for the aimed release of arrow 72. Supported on the bow is a prior art sight assembly 74 containing a multitude of sight pins 76.

Comparative illumination testing was conducted under controlled ambient light conditions for the sight pins 12, and 64 hereof against commercially available sight pins identified below with results (watt/sq. meter) at the sight tip as follows:

TABLE 1

| UNIT | ACTIVE AREA (sq. m) | OUTPUT (watt/ sq. m.) |
|---|---|---|
| | (at controlled ambient light of .0093 watt/sq. m) | |
| PIN 12 | 5.959 E-07 | 0.0651 |
| PIN 64 | 7.912 E-07 | 0.0685 |
| (1) | 2.556 E-06 | 0.0061 |
| (2) | 1.887 E-06 | 0.0047 |

TABLE 1-continued

| UNIT | ACTIVE AREA (sq. m) | OUTPUT (watt/ sq. m.) |
|---|---|---|
| | (at controlled ambient light of .0093 watt/sq. m) | |
| (3) | 1.590 E-06 | 0.0042 |

(1) Saunders "T-DOT"
(2) Cobra "ULTRA BRIGHT" sight pin
(3) Timberline Archery "NATURAL LIGHT" sight pin On the basis of the above it can be appreciated that the aim point indicia hereof is at least 40 percent smaller in size and yet about 1000 percent brighter than the existing units tested. As a result, the archer can now see more of the target area when aiming, thus allowing for a more exact aimpoint placement, while achieving greater accuracy in both hunting and target shooting.

By the above description there has been disclosed a novel sight unit pin for use on an archery bow affording significantly enhanced illumination at the tip of the sight pin than previously known. With a selected composition comprising the sight pin, significantly greater light output, even under low light conditions, is concentrated at its sighting end enabling increased aim visibility to the archer. The holder utilized to secure the pin in place can be readily mounted on an existing sight assembly as a replacement for an existing sight pin or can be utilized in the course of fabricating original equipment. Because of the unique configuration of the pin holder, it lends to a wide variety of selected arrangements in a multitude of different positions and orientations to effect various pin spacings on a multiple pin assembly. The virtues are many in resolving a long felt need in the archery art.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A sight pin unit adapted for use in an archery sight assembly to provide arrow aiming indicia at a sighting plane and comprising:

a predetermined length of a light gathering fluorescent fiber having a distal end at which gathered light is focused to comprise the arrow aiming indicia; and a holder to secure a segment length of said fiber while exposing the remaining length of the fiber to ambient light, said holder enabling the distal end of said fiber to be supported in a sighting relation relative to an established sighting plane to be utilized.

2. A sight pin unit in accordance with claim 1 in which the distal end of said fiber includes an enlarged lens formation at which said gathered light is focused.

3. A sight pin unit in accordance with claim 2 in which there is included a transparent sleeve closely enveloping at least the segment length of said fiber where secured by said holder.

4. A sight pin unit in accordance with claim 2 in which the distal end of said fiber is preceded by an angular offset in the axis of said fiber for laterally extending the distal end from said axis to the archery sight relation of the sighting assembly on which it is to be utilized.

5. A sight pin unit in accordance with claim 1 in which said holder defines an opening in which said fiber is received and there is included means to secure the fiber within said opening.

6. A sight pin unit in accordance with claim 1 in which said holder comprises a body, attachment means for mounting the body onto a sight assembly, a transverse bore through said body in which to receive said fiber and adjustment means operable in combination with said bore to secure said fiber in a clamping relation and to release said fiber from said clamping relation for position setting of its distal end relative to said sighting relation.

7. A sight pin unit in accordance with claim 6 in which said adjustment means includes a displaceable jaw formation in operable communication with said bore and an adjustment screw operable to displace said jaw toward and away from said clamping relation.

8. A sight pin unit in accordance with claim 7 in which said holder body is of an elongated block-like configuration, and said adjustment means is located toward one end of said body block containing said jaw.

9. A sight pin unit in accordance with claim 8 in which said one end in profile has a wedge-like configuration.

10. A sight pin unit in accordance with claim 7 in which said holder body includes an angular offset in a plane extending generally normal to the axis of said transverse bore.

11. A sight pin unit in accordance with claim 8 in which said holder body is comprised of tandem sections joined for relative displacement pivottally about a pivot axis.

12. A sight pin unit in accordance with claim 5 in which said holder comprises a tubular screw internally defining said opening.

13. A sight assembly for an archery bow including:

a body;

attachment means for mounting said body onto a bow; and a sight pin unit mounted on said body to provide arrow aiming indicia at a sighting plane and comprising:

a predetermined length of a light gathering fluorescent fiber having a distal end at which gathered light is focused to comprise the arrow aiming indicia; and a holder to secure a segment length of said fiber while exposing the remaining length of the fiber to ambient light, said holder enabling the distal end of said fiber to be supported in a sighting relation relative to said sighting plane.

14. A sight assembly in accordance with claim 13 in which the distal end of said fiber includes an enlarged lens formation at which said gathered light is focused.

15. A sight assembly in accordance with claim 14 in which there is included a transparent sleeve closely enveloping at least the segment length of said fiber where secured by said holder.

16. A sight assembly in accordance with claim 14 in which the distal end of said fiber is preceded by an angular offset in the axis of said fiber for laterally extending the distal end from said axis to said sighting relation.

17. A sight assembly in accordance with claim 13 in which said holder comprises a holder body, attachment means for mounting the holder body onto the sight assembly, a transverse bore through said holder body in which to receive said fiber and adjustment means operable in combination with said bore to secure said fiber in a clamping relation and to release said fiber from said clamping relation for position setting of its distal end relative to said sighting relation.

18. A sight assembly in accordance with claim 16 in which said adjustment means includes a displaceable jaw formation in operable communication with said bore and an adjustment screw operable to displace said jaw toward and away from said clamping relation.

19. A sight assembly in accordance with claim 18 in which said holder body is of an elongated block-like configuration, and said adjustment means is located toward one end of said body block containing said jaw.

20. A sight assembly in accordance with claim 18 in which said holder body includes an angular offset in a plane extending generally normal to the axis of said transverse bore.

21. A sight assembly in accordance with claim 19 including support means on which to support a plurality of said pin units in a multiple sight pin arrangement correlated to selected arrow aiming distances.

22. A sight assembly in accordance with claim 21 in which said support means is capable of supporting said plurality of sight pin units in a variety of arrangements and orientations.

23. A sight assembly in accordance with claim 16 in which said sight assembly includes a scope type sight having a tubular body and said holder is comprised of a tubular attachment to the body of said scope sight through which to receive and secure said fiber.

24. An archery set including:

a bow;

a sight assembly secured to said bow; and a sight pin unit mounted on said sight assembly to provide arrow aiming indicia at a sighting plane and comprising:

a predetermined length of a light gathering fluorescent fiber having a distal end at which gathered light is focused to comprise the arrow aiming indicia; and a holder to secure a segment length of said fiber while exposing the remaining length of the fiber to ambient light, said holder enabling the distal end of said fiber to be supported in a sighting relation relative to said sighting plane.

25. An archery bow set in accordance with claim 24 in which the distal end of said fiber includes an enlarged lens formation at which said gathered light is focused.

26. An archery bow set in accordance with claim 25 in which there is included a transparent sleeve closely enveloping at least the segment length of said fiber where secured by said holder.

27. An archery bow set in accordance with claim 25 in which the distal end of said fiber is preceded by an angular offset in the axis of said fiber for laterally extending the distal end from said axis to said sighting relation.

28. An archery bow set in accordance with claim 24 in which said holder comprises a holder body, attachment means for mounting the holder body onto the sight assembly, a transverse bore through said holder body in which to receive said fiber and adjustment means operable in combination with said bore to secure said fiber in a clamping relation and to release said fiber from said clamping relation for position setting of its distal end relative to said sighting relation.

29. An archery bow set in accordance with claim 28 in which said adjustment means includes a displaceable jaw formation in operable communication with said bore and an adjustment screw operable to displace said jaw toward and away from said clamping relation.

30. An archery bow set in accordance with claim 29 in which said holder body is of an elongated block-like configuration, and said adjustment means is located toward one end of said body block containing said jaw.

31. An archery bow set in accordance with claim 29 in which said holder body includes an angular offset in a plane extending generally normal to the axis of said transverse bore.

32. A sight pin unit adapted for use as an aiming device to provide aiming indicia at a sighting plane and comprising:

a predetermined length of a light gathering fluorescent fiber having a distal end at which gathered light is focused to comprise the aiming indicia; and a holder to secure a segment length of said fiber while exposing the remaining length of the fiber to ambient light, said holder enabling the distal end of said fiber to be supported in a sighting relation relative to an established sighting plane to be utilized.

33. A sight pin unit in accordance with claim 32 including support means for mounting said unit onto a projectile release type weapon.

34. A sight pin unit in accordance with claim 33 in which said weapon comprises an archery set and said projectile comprises an arrow.

35. A sight pin adapted to function as an aiming indicia at a sighting plane and comprising:

predetermined length of an optical light gathering fluorescent fiber having a distal end at which gathered light is focused to comprise the aiming indicia.

36. A sight pin in accordance with claim 35 in which the distal end of said fiber includes an enlarged lens formation at which said gathered light is focused.

* * * * *